United States Patent [19]

Lock

[11] Patent Number: 4,927,127

[45] Date of Patent: May 22, 1990

[54] ADJUSTABLE SUPPORT TABLE FOR MEDICAL USE

[75] Inventor: Willem Lock, Eindhoven, Netherlands

[73] Assignee: U.S. Philips Corporation, New York, N.Y.

[21] Appl. No.: 230,286

[22] Filed: Aug. 9, 1988

[30] Foreign Application Priority Data

Aug. 12, 1987 [GB] United Kingdom ..... 8719133

[51] Int. Cl.[5] ..... A61G 13/00

[52] U.S. Cl. ..... 269/322; 254/122

[58] Field of Search ..... 269/322–328; 254/122, 126

[56] References Cited

U.S. PATENT DOCUMENTS

| | | | |
|---|---|---|---|
| 3,034,765 | 5/1962 | Ludowici | 254/122 |
| 3,116,910 | 1/1964 | Moore et al. | 254/122 |
| 3,823,915 | 7/1974 | Koehler | 254/122 |
| 4,567,894 | 2/1986 | Bergman | 269/322 |
| 4,624,448 | 11/1986 | Lawman et al. | 254/122 |
| 4,720,082 | 1/1988 | Yang | 254/122 |
| 4,771,785 | 9/1988 | Duer | 269/322 |

*Primary Examiner*—Judy Hartman

*Attorney, Agent, or Firm*—William Squire; Jack Haken; Tom Briody

[57] ABSTRACT

A height-adjustable table for supporting a patient during medical examination or treatment in which a patient support table top mounted on a carrier 2 is connected to a base 3 by a parallelism maintaining linkage comprising a diamond or rhombus shaped linked assembly of four mutually pivoted equal struts 6, 7, 8, 9, pivotally attached top and bottom to the carrier 2 and to the base 3, and intermediately to the centers of first and second struts 17, 18 which are attached at their ends for free rectilinear displacement, to slides 20, 22, 24, 26, mounted on the carrier 2 and the base 3. Inextensible diagonal links 30, 32 connect diagonally opposed slides 24, 22 and 20, 26, to form an assembly of good horizontal and vertical stiffness even at the maximum height adjustment which is effected by e.g. a screw jack 5.

18 Claims, 4 Drawing Sheets

Fig.4.(a)
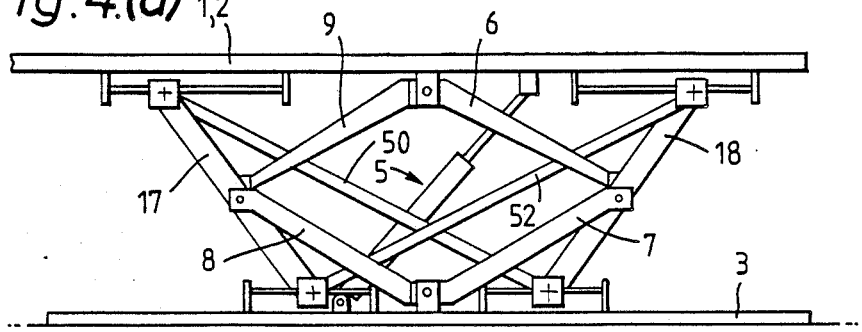
Fig.4.(b)
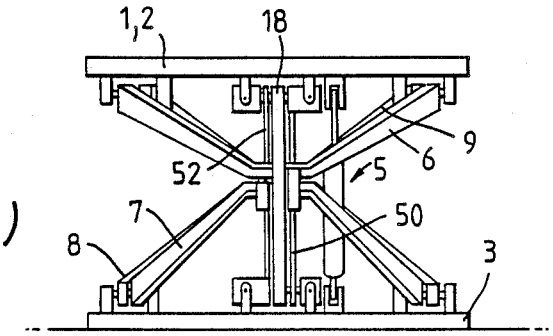
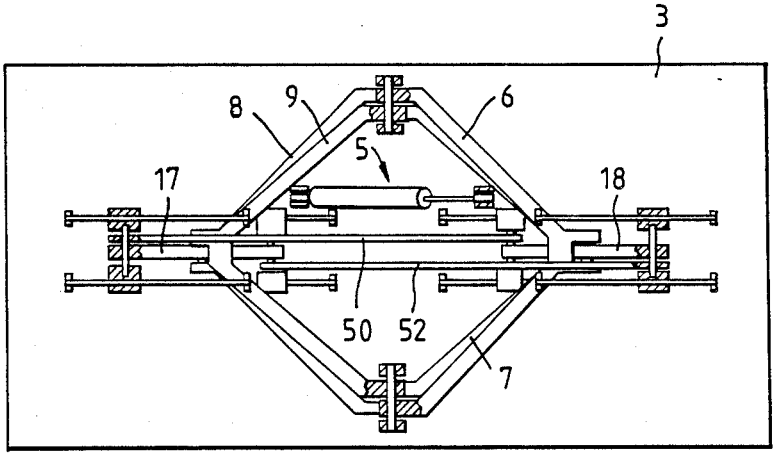
Fig.4.(c)

ADJUSTABLE SUPPORT TABLE FOR MEDICAL USE

BACKGROUND OF THE INVENTION

The invention relates to a table for supporting a patient for medical examination or treatment comprising, a carrier member including a support table top, a base member, a linkage assembly connecting the carrier member to the base member and arranged to maintain the table top substantially horizontal while permitting a relative vertical displacement to occur between the carrier member amd the base member, and adjustment means for effecting a said relative vertical displacement.

A common form of support for a patient support table top for example for radiography or radiotherapy, is a pedestal support located entirely beneath the table top usually near one end and arranged to raise or lower the table top. A known form of the linkage assembly of the kind referred to in the preamble, for use in such a pedestal support, comprises a double parallelogram linkage mounted on a horizontal base, and coupled at the upper extensible end ot a vertical linear guide. This arrangement has been found to lack sufficient stiffness to meet the more exacting standards required for some present day examination techniques.

Another known form of linkage assembly is the scissor or double scissor jack type of linkage. This arrangement can provide a good stiffness performance in the vertical direction even when extended to its maximum height, however, in the latter part of the range of heights the horizontal stiffness becomes unsatisfactory and has to be improved by the use of extra guide members.

SUMMARY OF THE INVENTION

It is an object of the invention to provide an improved adjustable table for supporting a patient.

According to the invention there is provided a table for supporting a patient for medical examination or treatment comprising, a carrier member including a support table top, a base member, a linkage assembly connecting the carrier member to the base member and arranged to maintain the table top substantially horizontal while permitting a relative vertical displacement to occur between the carrier member and the base member, and adjustment means for effecting a said relative vertical displacement, characterised in that the linkage assembly comprises a vertically disposed diamond or rhombus shaped assembly of four linked struts pivotally joined end to end to one another in which the distance between the pivots on each of the struts is the same and the upper and lower pivotal joints are pivotally mounted at a corresponding fixed point on the carrier member and on the base member, respectively, first and second support struts situated on respective sides of said assembly and each pivotally connected at corresponding ends to the carrier member and to the base member, respectively, via a corresponding horizontally displaceable bearing means arranged so that the pivotal axes of said support struts and the pivotal axis of the corresponding pivotal mounting of the assembly of linked struts, are maintained parallel to one another and coplanar in respective parallel upper and lower defining planes, the mid point of each of the first and second support struts being pivotally attached to a corresponding intermediate pivotal joint of the assembly of linked struts, and at least one pair of substantially inextensible diagonally arranged supporting linkages of equal effective length each pivotally attached at their respective ends coaxially with the corresponding pivotal axis of diagonally opposed respective upper and lower said horizontally displaceable bearing means for the respective first and second support struts.

The first and second struts and each of the four linked struts can each comprise two spaced parallel arms rigidly connected together by intermediate bracing means, and cna be formed as a sheet steel pressing. Alternately the first and second support struts can each comprise a single arm moving in a vertical plane through the longitudinal axis of the table top, and the four linked struts can take the form of wishbones with widely spaced pivotal mountings to provide the required rotational stiffness about a central vertical axis through the linking assembly.

The horizontally displaceable bearing means can each comprise a guided member carrying the common pivot for the first or second support strut and diagonal supporting linkage, and a rectilinear guide rail rigidly mounted on the associated carrier or base member. The guided member is arranged to engage the guide rail to enable free relative displacement therealong while providing positive location with respect to any tendency to relative displacement transversely to the guide rail. The guided member can comprise a slide or can be provided with respective rollers each arranged to engage a corresponding surface region of the guide rail in a distribution of lateral directions arranged so that the guided member is positively located transverse to the direction of free relative displacement along the guide rail.

The horizontally displaceable bearing means can, alternatively, each comprise a roller rotationally mounted on a shaft which engages via a common pivotal and rotational axis, the corresponding end of the first or second support strut and of a diagonal supporting linkage, and a rectilinear bearing surface rigidly mounted on the corresponding carrier or base member, which the roller engages so as to enable free motion along the surface while providing positive location in a direction towards the bearing surface. The bearing surface is preferably formed as a channel and the corresponding roller formed to engage a portion of the side wall of the channel in order to locate the roller in a horizontal direction transverse to that of free relative displacement. Alternatively the bearing surface can take the form of a rail, and the outer surface of the roller can have a central groove or channel so that for example the bottom of the groove would contact the support bearing upper surface of the rail and the sides of the groove would act as flanges for sideways location. Alternatively a V grooved roller can be employed with a rounded surface rail to combine the function of bearing and lateral guidance at the corresponding areas of contact.

The adjustment means for raising and lowering the table top can take the form of a manual adjustment such as a screwjack, or can include motive means such as a linear thrust motor arranged to provide a linear displacement via an output displacement member. This can comprise an electric motor driven screw jack or a hydraulic ram. A favourable arrangement is to connect the body of the linear thrust motor to one intermediate pivotal joint of the assembly of linked struts and to connect the output displacement member to the other intermediate pivotal joint. It must be understood, however, that in this case the linear motor has to provide a tension force between the two points of attachment. An alternative arrangement is for the output of the thrust motor to be applied between the base member and the carrier member to provide a vertical displacement directly. If the thrust axis of the motor is vertical, the amount of lift will be limited to less than 2:1 which is less than the useful vertical adjustment range of the linkage assembly in a table in accordance with the invention. To overcome this limitation a multiple extensin motor arrangement could be employed, or the single action thrust motor can be mounted in a manner inclined to the vertical. In further alternative arrangements the thrust motor can be mounted to operate horizontally between the base and a lower common axis of the first or second strut or between the carrier member and the upper end of the first or second strut. The thrust motor can be a double acting motor arranged to give equal and opposite displacements to the corresponding ends of both the first and second struts.

The diagonally arranged supporting linkages can each be formed by an inextensible flexible linkage such as a steel cable since under normal circumstances the linkages are always under tension, however a rigid strut can be employed if desired.

The invention is based on the realisation that a patient support table top and a horizontal base can be connected together by an improved linkage assembly based on a new combination of the geometrical properties of parallelism, triangularity and proportionality which can maintain the table top horizontal throughout a large relative vertical displacement while at the same time providing a uniformly good degree of vertical and horizontal stiffness especially at the maximum height setting without the need to use auxiliary guide means.

A patient support table in accordance with the invention provides the advantage that in the highest position setting good positional accuracy can be obtained together with a good degree of both horizontal and vertical stiffness which can be well maintained as the table top is lowered. The table further provides a height variation greater than 2:1 without the need to use extension guide members, and only requires a relatively compact base area which is sufficient to give good stability throughout the range of height adjustment and can therefore readily be mounted on a wheeled trolley base.

BRIEF DESCRIPTION OF THE DRAWING

Embodiments of the invention will now be described by way of example, with reference to the accompanying drawings, of which:

FIGS. 4*a*, 4*b*, 4*c* are line diagrams illustrating a different embodiment of a patient table in accordance with the invention from similar viewpoints to those of FIGS. 1, 2 and 3.

DETAILED DESCRIPTION OF THE PREFERRED EMBODIMENTS

Figure 1:
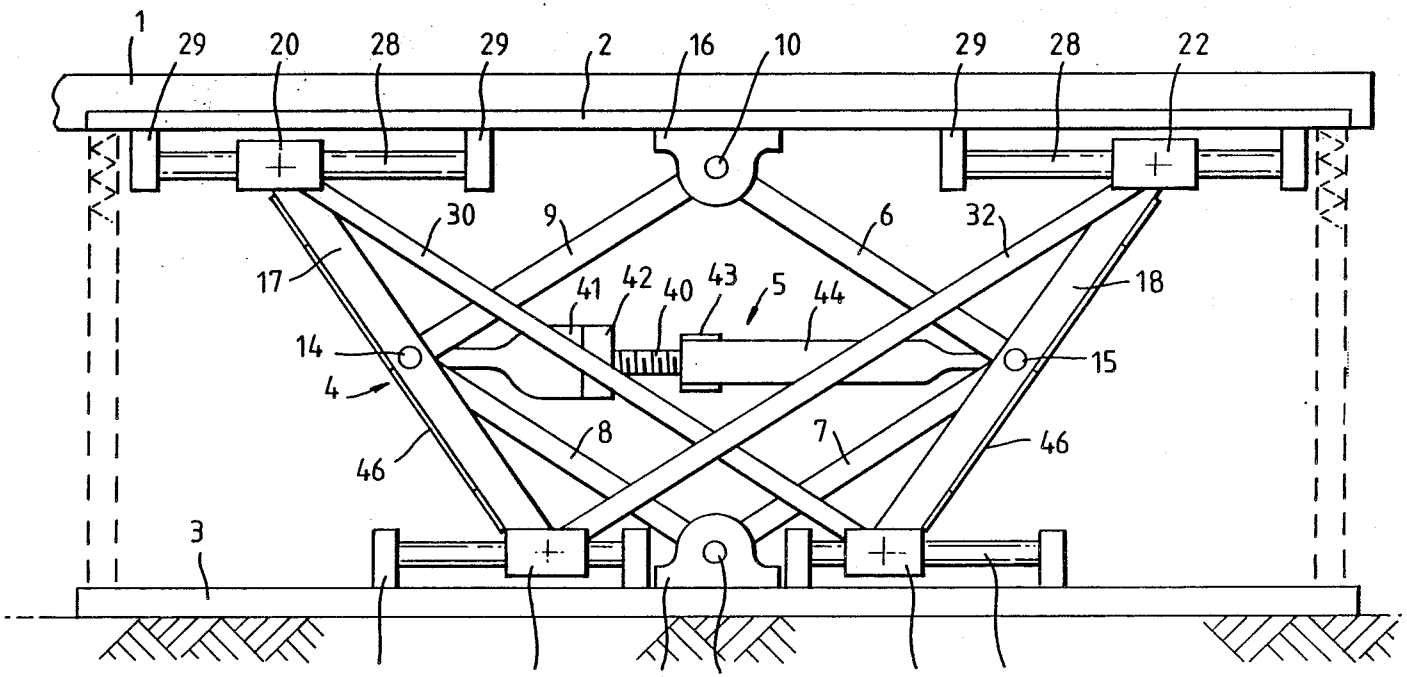
FIG. 1 is a front elevation of the pedestal portion of a patient support table in accordance with the invention with the outer protective cover removed.
Figure 2:
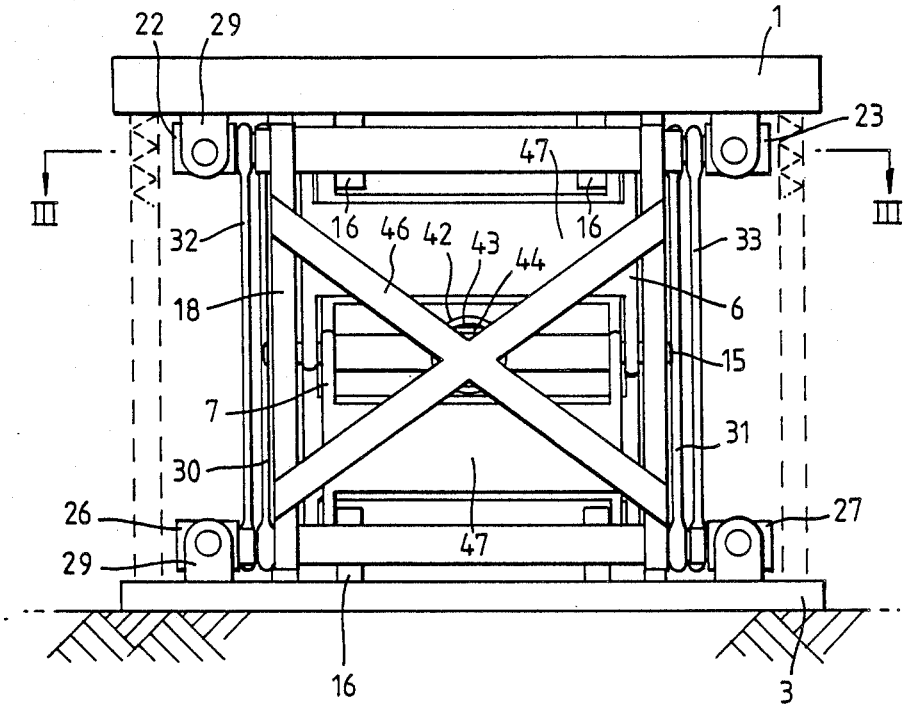
FIG. 2 is an end elevation of the patient support table of FIG. 1.
Figure 3:
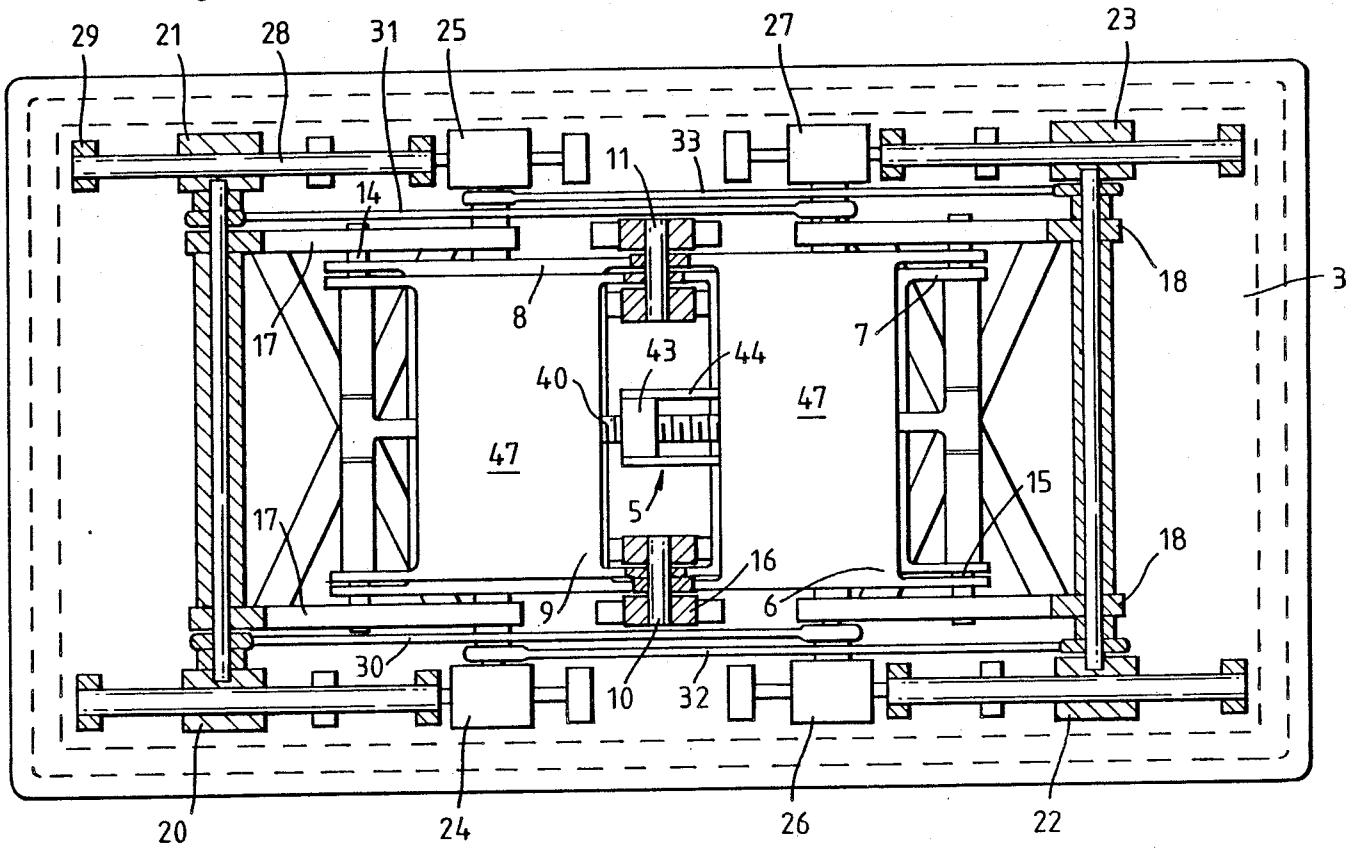
FIG. 3 is a plan view of the pedestal portion shown in FIG. 1.

Referring to FIGS. 1, 2 and 3 which illustrate diagrammatically a patient support table according to the invention, a patient support table top 1 is mounted on, or if desired may itself form a carrier member 2 which is connected to a base member 3 by means of a linkage assembly 4 which is arranged to maintain the table loop 1 substantially horizontal while permitting a relative vertical displacement to occur between the carrier member 2 and the base member 3. Motive means 5, conveniently a linear thrust motor formed in the present example by a screw jack driven via a reduction gear by an electric motor, is provided for effecting the relative vertical displacement so that the patient table top 1 may be raised or lowered in a controlled manner.

In accordance with the invention the linkage assembly 4 comprises a vertically disposed diamond or rhombus shaped assembly of four linked struts 6, 7, 8, 9 pivotally joined end to end to one another, first and second support struts 17 and 18 situated on respective sides of the diamond-shaped assembly, and a pair of substantially inextensible diagonally arranged supporting linkages which are normally under tension and can therefore, if desired, be flexible and formed for example from steel cable but in the present embodiment are formed by respective pairs of rigid struts 30, 31 and 32, 33. The distance between the pivotal axes at the respective ends of each of the linked struts 6, 7, 8 and 9 is the same for each strut, and the upper and lower pivotal joints 10, 11 and 12, are pivotally mounted at a corresponding fixed point on the carrier member 2 and on the base member 3, respectively. The first and second support struts 17 and 18 situated to the respective sides of the assembly 6, 7, 8 and 9, are each pivotally attached at corresponding upper and lower ends to the carrier member 2 and to the base member 3, respectively, via a corresponding horizontally displaceable bearing means each comprising a guided member formed in the present embodiment by a slide member 20, 21, 22, 23, and 24, 25, 26, 27 to which the corresponding end of the respective strut 17, 18, is attached by means of a pivot, and a respective straight supporting guide rail, 28, firmly attached by end supports 29 to the corresponding carrier member 2 or base member 3, along which the guided member is freely horizontally displaceable.

As an alternative to a slide member each slide-like guided member can be provided with a spaced plurality of rollers each arranged to engage a corresponding surface region of the guide rail in a distribution of lateral directions arranged ot locate the slide-like member in a positive manner transversely with respect to the guide rail.

The guide rails 28 must be arranged so that the pivotal axes of the corresponding ends of the struts 17 and 18 always move in a coplanar manner with respect to each other and to the corresponding upper or lower pivotal axes at 10, 11, or 12 of the linked struts 6, 7, 8 and 9, for example the axes at 20, 21, 22, 23 and 10, 11, must be maintained parallel to one another and coplanar in an upper horizontal defining plane, and the axes at 24, 25, 26, 27, and 12 must be parallel to one another and coplanar in a corresponding lower horizontal defining plane. Each of the first and second supporting struts 17 and 18 are pivotally attached at their mid-points to a corresponding intermediate pivotal joint 14, 15, of the assembly of linked struts 6, 7, 8, 9. The respective ends of each diagonally arranged strut 30, 31 and 32, 33, is pivotally attached coaxially with a corresponding diagonally situated pivotal end attachment of the respective support struts 17 and 18 to the associated horizontally displaceable slide member 20, . . . , 27. The effective lengths of all the struts 30, 31, 32, 33 measured between the centres of the pivotal axes, are equal to one another and are equal to that of the diagonals formed when the support struts 17 and 18 are vertical, which is of course the situation for the maximum height of the table top. It is desirable that the distance apart of the struts 17 and 18 when vertical should not be appreciably less than the height of the struts 17, 18, otherwise as the table is lowered the two lower support points for struts, namely the slide members 24, 25 and 26, 27, will tend to move too close together to provide a satisfactory firm fore and aft support for the table.

As an alternative to the use of a slide and guide rail to form the horizontally displaceable bearing means, the latter can each comprise a roller rotationally mounted ona shaft which latter engages via a common pivotal and rotational axis the corresponding end of the associated first or second support strut 17, 18 and of the associated diagonal supporting linkage 30, 31, 32, 33, and a rectilinear bearing surface rigidly mounted on the corresponding carrier or base member 2, 3. Each roller would be urged into engagement with the corresponding bearing surface by the weight of the table top pressing down on the linkage assembly. In fact the various pivotal and bearing elements of the linking assembly of a patient support table in accordance with the invention, will normally tend to be urged into positive contact with one another by the applied weight. The system can therefore be regarded as a force-closed system, a factor which will tend to reduce the uncertainty effects of any free play in bearings, thus increasing rigidity and locational accuracy.

In the modification employing a roller as the guided member, the bearing surface can be formed as a recessed channel and the corresponding roller can be formed to engage a region of the side wall of the channel in order to locate the roller in a horizontal direction transverse to that of the required free relative displacement. In an alternative modification, the bearing surface can take the form of a rail and the outer surface of the roller can have a central groove or channel so that, for example, the bottom of the groove contacts the support bearing surface which would comprise the upper surface of the rail and the sides of the groove would act as flanges for sideways location. Alternatively a roller with a V-shaped groove can be employed with a rounded rail surface so that the fnctions of bearing surface and sideways location are combined at each area of contact.

The raising, lowering and vertical location of the table top 1 is effected by adjustment means 5 in the form of motive means comprising a screw jack including a threaded shaft 40 driven by an electric motor 41 via a reduction gear assembly 42 the housing of which is attached to one of the intermediate pivoted joints 14. The threaded shaft 40 engages a nut 43 supported in a frame 44 attached to the other intermediate pivoted joint 15. In order to allow for any misalignment the shaft 40 and the nut 43 should be supported by a form of cardanic assembly. In the interests of safety it is also desirable to provide an idler nut (not shown) to the right, in FIG. 1, of the nut 43 which follows the nut 43 under no-load conditions to provide emergency support if the thread of the nut 43 were to fail in operation.

It should be noted that the screw jack arrangement shown in FIGS. 1, 2 and 3 can, if desired, be readily adapted to a form of manual adjustment of the height of the table top 1. For this purpose the electric motor 41, and possibly the gear assembly 42, can be replaced by a handwheel or hand crank mountedon the end of the threaded shaft 40 or the input shaft of the gearbox. The screw jack would preferably be mounted the opposite way round with the frame 44 attached to the pivot 14 and the threaded shaft assembly attached to the pivot 15 to provide better access to the manual adjustment member. For safety, a form of brake would be provided to lock the threaded shaft once adjusted. It will be understood that in both the motorised and manual forms, a tension force is exerted between the two intermediate joints 14, 15, by the weight of the table top.

In an alternative arrangement the screw jack 40, 43, can be directed upwardly between the base member 3 and the carrier member 2. In this case the jack will be exerting a compressive force and the safety idler nut would have to be relocated on the other side of the load bearing nut 43, i.e. between the nut 43 and the motor and gearbox.

If the threaded shaft 40 were arranged vertially the range of height adjustment of the table top 1 would be restricted to less than 2:1 using a single extension screw jack of the kind illustrated in FIG. 1. This range is significantly less than the useful range which the present linkage can provide satisfactorily. To overcome this a multiple extension screw jack could be employed vertically or, preferably, the single extension screw jack can be mounted obliquely to the vertical, as illustrated in FIG. 4(*a*).

In further alternative arrangements, the screw jack 40, 43 can be directed horizontally to operate between a fixed point on either the carrier member 2 or the base member 3 and the upper or lower end, respectively, of a corresponding one of the support struts 17, 18.

Other arrangements and forms of the motive means 5 can be employed. The screw jack can be rearranged to operate, for example, in a balanced manner between the lower ends of the support struts 17, 18, or between the upper ends of these struts. Balanced operation can be achieved by employing a lead screw with an opposite handed thread formed over one end thereof to function in cooperation with an opposite handed threaded nut. Thus rotation of the lead screw will cause driven nuts at each end connected to the respective struts 17, 18, to move horizontally by equal amounts in opposite directions. Alternatively two parallel lead screws having the same handedness can be geared together so as to turn in opposite directions to achieve the same effect.

The screw jack arrangement can be replaced by one or more hydraulic actuators in the form for example of rams. If this were carried out, however, some suitable form of mechanical brake would be desirable to guard against the effects of failure or creep.

The embodiment described with reference to FIGS. 1, 2 and 3 employs a linkage arrangement 4 having a rectangular outline in plan view. In this arrangement each main support strut 17, 18, is formed by two parallel strut-like side pieces rigidly joined by one or more intermediate bracing pieces 46, and the linked struts 6, 7, 8, 9, are each similarly formed by two spaced arms rigidly joined by rectangular bracing pieces 47. However, a patinet support table top in accordance with the invention, can be formed in the manner illustrated by the line diagrams of FIGS. 4*a*, 4*b*, and 4*c* which represent the viewpoints shown in FIGS. 1, 2, and 3, respectively. In this embodiment each of the main struts 17, 18 is formed by a single arm located in a vertical plane through the central axis of the table top 1, and only requires a single slide attachment at the top and at the bottom, respectively, for each strut. The linked struts 6, 7, 8, 9, are triangular in form thus displaying a diamond-shaped structure in plan view, and bracing the single struts 17, 18, against any tendency for the supported table to rotate about a vertical axis. The screw jack 5 is arranged obliquely between teh carrier 2 and the base 3 and is displaced sideways out of the central plane to allow single diagonally arranged supporting struts 50, 52, to be accommodated between the opposed ends of the single supporting struts 17, 18. It will be apparent that from the viewpoint of FIG. 4*a*, this linkage assembly is geometrically equivalent to that shown in FIG. 1, and can provide a similar degree of horizontal stabilisation of the table top as the latter is raised or lowered.

A patient support table as described herein and claimed in the appended claims, can be employed for a variety of medical purposes such as radiography, radiotherapy, or other forms of medical examination, treatment or surgery. It is not however intended to limit the claims to a patient support table since the form of adjustable height table described and claimed herein can be applied with advantage to other uses where a supporting table top must be adjustable in height but maintained parallel to the supporting base and must have good vertical and horizontal stiffness. The table can readily be adjusted in height by means of a manual control such as a handwheel or hand crank coupled to a screw jack and the arrangement shown in FIG. 1 can be readily adapted to this form of height adjustment.

From reading the present disclosure, other modifications will be apparent to persons skilled in the art. Such modifications may involve other features which are already known in the design, manufacture and use of adjustable tables and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicity or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

What is claimed is:

1. A table for supporting a patient comprising, a carrier member including a support table top, a base member below said carrier member, a linkage assembly means connecting the carrier member to the base member for maintaining the table top substantially horizontal while permitting a relative vertical displacement to occur between the carrier member and the base member, and adjustment means for effecting a said relative vertical displacement between the carrier member and the base member, wherein the linkage assembly means comprises a rhombus shaped assembly of four linked struts pivotally joined end to end to one another by a series of pivotal joints including an upper pivotal joint pivotally mounted on the carrier member, a lower pivotal joint pivotally mounted on the base member, and first and second intermediate pivotal joints on opposite sides of said rhombus shaped assembly, said series of pivotal joints having pivot axes parallel to each other, first and second support struts on opposite sides of said rhombus shaped assembly and each having an upper and a lower end and a mid point between said upper and lower ends, first upper and first lower horizontally displaceable bearing means respectively pivotally connecting the upper and lower ends of the first support strut to the carrier member and the base member, second upper and second lower horizontally displaceable bearing means respectively pivotally connecting the upper and lower ends of the second support strut to the carrier member and the base member, said first and second, upper and lower, horizontally displaceable bearing means having pivot axes parallel to the pivot axes of said series of pivotal joints, the mid points of the first and second support struts being respectively pivotally attached to the first and second intermediate pivotal joints, and first and second substantially inextensible supporting linkages of equal effective length, each said supporting linkage having an upper and a lower end, said first supporting linkage being pivotally attached at its upper and lower ends respectively coaxially with the pivot axes of the first upper and second lower horizontally displaceable bearing means and said second supporting linkage being pivotally attached at its upper and lower ends respectively coaxially with the pivot axes of the second upper and first lower horizontally displaceable bearing means.

2. A table as claimed in claim 1, wherein the first support strut comprises a first pair of parallel arms rigidly connected together by a first intermediate bracing member and wherein the second support strut comprises a second pair of parallel arms rigidly connected together by a second intermediate bracing member.

3. A table as claimed in claim 1, wherein each of the four linked struts comprises a pair of spaced parallel arms rigidly joined by an intermediate bracing piece.

4. A table as claimed in claim 1, wherein said four linked struts and said first and second support struts are formed from sheet steel pressings.

5. A table as claimed in claim 1, wherein said table top has a longitudinal axis, each of the first and second support struts comprises a single arm substantially disposed in a vertical plane through the longitudinal axis of the table top, and each of the four linked struts comprises two side arms respectively connected at one end to two widely spaced pivotal mountings forming said upper or said lower pivotal joint, the other ends of the side arms being brought together at one of said intermediate pivotal joints.

6. A table as claimed in claim 1, wherein each of the first and second upper horizontally displaceable bearing means comprises an upper guide rail rigidly mounted on the carrier member and an upper guided member engaging the upper guide rail to enable rectilinear motion therealong, each of the first and second lower horizontally displaceable bearing means comprises a lower guide rail rigidly mounted on the base member and a lower guided member engaging the lower guide rail to enable rectilinear motion therealong, said upper and lower guided members carrying the said pivot axes of said upper and lower horizontally displaceable bearing means.

7. A table as claimed in claim 6, wherein each of said upper and lower guided members is a slide member.

8. A table as claimed in claim 1, wherein said adjustment means comprises manual adjustment means.

9. A table as claimed in claim 8, wherein the manual adjustment means comprises a screw jack assembly having a body which is connected to one of the intermediate pivotal joints and a threaded displacement member which is connected to the other intermediate pivotal joint.

10. A table as claimed in claim 1 or claim 5, wherein the adjustment means comprises motive means in the form of a linear thrust motor which provides a linear displacement via an output displacement member, the thrust motor being connected to one of the intermediate pivotal joints and the output displacement member being connected to the other intermediate pivotal joint.

11. A table as claimed in claim 1 or claim 5, wherein the adjustment means comprises motive menas in the form of a thrust motor which provides a linear displacement via an output displacement member, the thrust motor or the output displacement member being connected pivotally to the base member or the carrier member.

12. A table as claimed in claim 11, wherein the thrust motor has a linear thrust axis which is inclined relative to the vertical direction.

13. A table as claimed as claim 10, wherein the thrust motor comprises a driven screw jack.

14. A table as claimed in claim 10, wherein the thrust motor comprises a hydraulic ram.

15. A table as claimed in claim 1, wherein said first and second supporting linkages are flexible.

16. A table as claimed in claim 15, wherein each of said first and second supporting linkages comprises a steel cable.

17. A table as claimed in claim 1, each of the first and second supporting linkages comprises a rigid strut.

18. A table as claimed in claim 1 or claim 5, wherein the adjustment means comprises motive means in the form of a thrust motor which provides a linear displacement via an output displacement member, the thrust motor or the output displacement member being connected pivotally to an axis coaxial with the pivot axis of a first or second, upper or lower horizontally displaceable bearing means.

* * * * *